US009073367B2

(12) United States Patent
Watanabe

(10) Patent No.: US 9,073,367 B2
(45) Date of Patent: Jul. 7, 2015

(54) PRINTER

(71) Applicant: SATO HOLDINGS KABUSHIKI KAISHA, Tokyo (JP)

(72) Inventor: Atsushi Watanabe, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/376,734

(22) PCT Filed: Dec. 5, 2012

(86) PCT No.: PCT/JP2012/081534

§ 371 (c)(1),
(2) Date: Aug. 5, 2014

(87) PCT Pub. No.: WO2013/121656

PCT Pub. Date: Aug. 22, 2013

(65) Prior Publication Data

US 2015/0029290 A1 Jan. 29, 2015

(30) Foreign Application Priority Data

Feb. 13, 2012 (JP) ..... 2012-028162
Sep. 19, 2012 (JP) ..... 2012-205356

(51) Int. Cl.

| | |
|---|---|
| ***B41J 11/04*** | (2006.01) |
| ***B41J 3/407*** | (2006.01) |
| ***B41J 11/46*** | (2006.01) |
| ***B41M 5/382*** | (2006.01) |

(52) U.S. Cl.

CPC ..... *B41J 11/04* (2013.01); *B41J 3/4075* (2013.01); *B41J 11/46* (2013.01); *B65H 2511/512* (2013.01); *B65H 2701/194* (2013.01); *B41M 5/382* (2013.01)

(58) Field of Classification Search

CPC .. B65H 2511/512; B41J 11/04; B41J 3/4075; B41M 5/382
USPC ..... 347/110, 217, 218, 171
See application file for complete search history.

(56) References Cited

U.S. PATENT DOCUMENTS 6,172,688 B1 * 1/2001 Iwasaki et al. ..... 347/2
2014/0152753 A1 * 6/2014 Moriyama et al. ..... 347/110

FOREIGN PATENT DOCUMENTS

JP 5-278297 10/1993
JP 7-196237 8/1995

(Continued)

OTHER PUBLICATIONS

International Search Report dated Mar. 12, 2103 issued in corresponding International patent application No. PCT/JP2012/081534.

*Primary Examiner* — Sarah Al Hashmi
(74) *Attorney, Agent, or Firm* — Ostrolenk Faber LLP

(57) ABSTRACT

A label printer capable of keeping the printed contents from exceeding the bounds of the label. The printer (10) detects the leading edge of a sheet of paper (1) as well as eye marks using a detecting sensor (70). Cueing is performed by a control unit (40). When the difference between the length of the sheet of paper (1) from the leading edge to the first eye mark and the length of the sheet of paper (1) from the first eye mark to the second eye mark is less than a threshold value, printing is started from the first label and when the difference is at or above the threshold value, printing is started from the second label.

9 Claims, 3 Drawing Sheets

(56) References Cited

FOREIGN PATENT DOCUMENTS

| | | | | |
|---|---|---|---|---|
| JP | 2000-30015 | | | 1/2000 |
| JP | 2004-90227 | | | 3/2004 |
| JP | 2004090227 | A | * | 3/2004 |
| JP | 2005-280226 | | | 10/2005 |
| JP | 2008-009537 | | | 1/2008 |
| JP | 2010-228839 | | | 10/2010 |
| WO | WO 2009/004728 | A1 | | 1/2009 |

* cited by examiner

PRINTER

CROSS-REFERENCE TO RELATED APPLICATIONS

The present application is a 35 U.S.C. §§371 national phase conversion of PCT/JP2012/081534, filed Dec. 5, 2012, which claims priority of Japanese Patent Application No. 2012-028162, filed Feb. 13, 2012, and Japanese Patent Application No. 2012-205356, filed Sep. 19, 2012, the contents of which are incorporated by reference herein. The PCT International Application was published in the Japanese language.

TECHNICAL FIELD

The present invention relates to a printer.

BACKGROUND ART

A printer that performs thermal-transfer printing or dye-sublimation thermal-transfer printing uses ink ribbons. A printer capable of performing color printing uses ink ribbons of four colors including cyan (C), magenta (M), yellow (Y), and black (K). The ink ribbons of CYMK are arranged in line, carried by platen rollers for the corresponding colors, and sequentially printed on a label as a printing target by thermal heads for the corresponding colors.

PTL 1 Japanese Unexamined Patent Application Publication No. 2004-90227 discloses a printer capable, even when high-speed printing is performed, of stably transferring a label continuous body in which a plurality of labels are temporarily attached to a belt-like liner, and performing printing within a predetermined printing area.

SUMMARY OF INVENTION

Technical Problem

When setting a sheet member such as label continuous body to a printer to start printing, it is necessary to carry out strict positioning, called cueing, of a leading end of the label continuous body. There has been a problem that when the cueing is not strictly carried out, a position for starting the printing may be wrong, e.g. go out of alignment, and printing on a first label may not be appropriately performed. Thus, printing content may be printed outside the label.

An object of the present invention is to provide a printer capable of preventing the printing content from being printed outside a sheet or label continuous member while improving usability for an operator.

Solution to Problem

The present invention addresses the above problem employing the following solutions.

A first aspect of the invention provides a printer for performing printing on a sheet or label continuous body. The printer includes: a leading end detector configured to detect a leading end of the sheet; another end portion detector configured to detect an end portion of each sheet; a transfer device configured to transfer the sheet; and a control device configured to obtain a length of one of the labels that is adjacent to the leading end of the sheet, based on results of the detection by the leading end detector and the end portion detector, and to control the transfer device according to a result that has been detected.

A second aspect of the invention provides a label printer according to the first aspect, in which the sheet is provided with identification marks in association with each of the or label continuous body of the sheet, and the end portion detector detects the end portion of each of the labels of the sheet by detecting the identification marks.

A third aspect of the invention provides the printer according to at least one of the first or the second aspect, in which the control device performs: a first step of obtaining a length of the sheet after the leading end is detected by the leading end detector until a rear end portion of a first of the labels of the sheet adjacent to the leading end is detected by the end portion detector; a second step of obtaining a length of the sheet after the rear end portion of the first of the labels of the sheet is detected by the end portion detector until a rear end portion of a second of the labels of the sheet is detected by the end portion detector; and when a difference between the length obtained in the first step and the length obtained in the second step is smaller than a predetermined threshold value, a third step of starting printing on the first of the labels adjacent to the leading end of the sheet, and when the difference between the length obtained in the first step and the length obtained in the second step is equal to or greater than the threshold value, starting printing on the second of the labels of the sheet.

A fourth aspect of the invention provides a label printer according to the third aspect, in which when the difference between the length obtained in the first step and the length obtained in the second step is smaller than the threshold value, then in the third step, the control device starts printing on the first of the labels of the sheet, assuming that a length of the sheet from the leading end of the sheet to the rear end portion of the first of the labels of the sheet is equal to an average of the length obtained in the first step and the length obtained in the second step.

Advantageous Effect of Invention

According to the present invention, it is possible to prevent printing content from being printed outside a sheet member while improving usability for an operator.

DESCRIPTION OF EMBODIMENTS

Hereinafter, a best mode for carrying out the present invention will be described with reference to the drawings.

Embodiment

Figure 1:
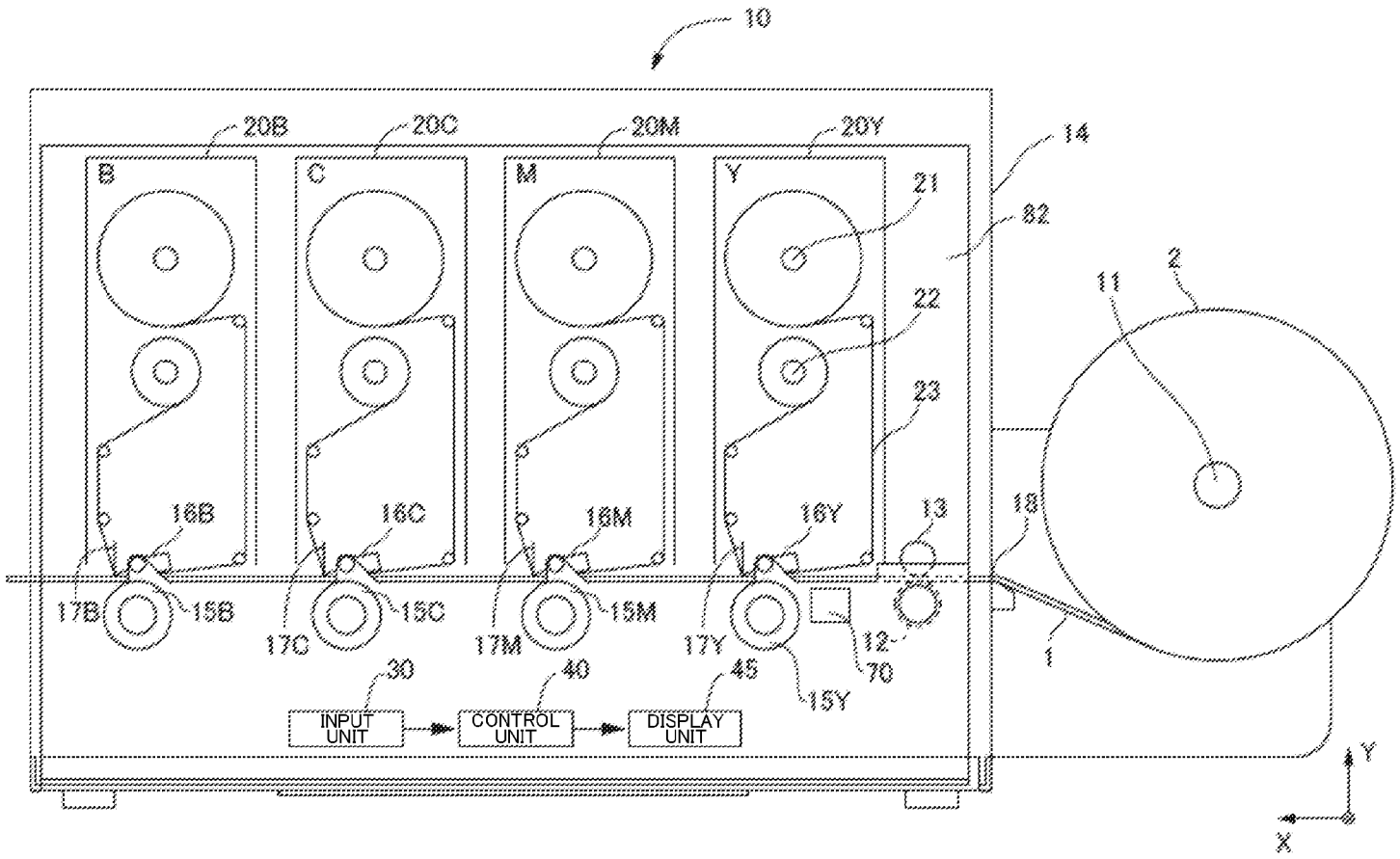
FIG. 1 is a diagram schematically illustrating an embodiment of a printer according to the present invention.

FIG. 1 illustrates an embodiment of a printer.

Throughout the drawings including FIG. 1, XYZ orthogonal coordinates show same directions. The X, Y, and Z merely indicate the directions, and not an absolute position, such as an origin position.

Further, all the drawings including FIG. 1 show general outlines, and sizes and shapes of components are shown with exaggeration as appropriate in order to facilitate understanding.

In addition, while values, shapes, materials, and the like are specifically stated in the following description, they may be altered as needed.

A printer 10 is a thermal-transfer type color label printer for printing on a label continuous body (paper sheet) of labels temporarily attached to a liner as a sheet. The printer performs printing by transferring a plurality of different color inks of the ink ribbons to the paper sheet. In the following example, printing is performed using ink ribbons of four colors including yellow (Y), magenta (M), cyan (C), and black (B), for example.

Referring to FIG. 1, the paper sheet 1 is in a paper roll 2 rolled in a rolled up state. It is rotatably supported around a sheet feed shaft 11 provided for a housing 14 of the printer 10. The paper sheet 1 pulled from the sheet feed shaft 11 enters the housing 14 through a paper sheet supply inlet 18, and is held and transferred between a drive roller 12 and a pressure roller 13.

Further, the housing 14 is provided with four ink ribbon cassettes 20Y, 20M, 20C, and 20B along a transfer direction of the paper sheet 1, from an upstream side of the transfer direction (right in the Figure) to a downstream side of the transfer direction (left in the Figure). For example, the ink ribbon cassette 20Y is loaded with an ink ribbon of yellow (Y); the ink ribbon cassette 20M is loaded with an ink ribbon of magenta (M); the ink ribbon cassette 20C is loaded with an ink ribbon of cyan (C); and the ink ribbon cassette 20B is loaded with an ink ribbon of black (B).

There are disposed within the housing 14 of the printer 10 and corresponding respectively to the four types of ink ribbon cassettes 20Y-20B, four platen rollers 15Y, 15M, 15C, and 15B, four thermal heads 16Y, 16M, 16C, and 16B, and four separation plates 17Y, 17M, 17C, and 17B along the transfer direction of the paper sheet. The respective thermal heads 16Y-16B are respectively inserted into the ink ribbon cassettes 20Y-20B. Further, the thermal heads 16Y-16B are positioned so as to face respectively against the platen rollers 15Y-15B. The separation plates 17Y-17B are positioned on the downstream side respectively from the thermal heads 16Y-16B. The four platen rollers 15Y-15B, the four thermal heads 16Y-16B, and the four separation plates 17Y-17B of the respective colors constitute four printing units in combination. Each of the printing units performs printing using a corresponding one of the ink ribbon cassettes 20Y-20B that are respectively set.

For each of the four types of ink ribbon cassettes 20Y-20B, an ink ribbon 23 is suspended over an ink ribbon supply shaft 21 and an ink ribbon take-up shaft 22. The ink ribbon take-up shaft 22 is driven and rotated by a motor provided within the housing.

The unused ink ribbon 23 that is in the rolled state, and supported around the ink ribbon supply shaft 21 of the ink ribbon cassette 20Y of yellow is fed along with the paper sheet 1 between the platen roller 15Y and the thermal head 16Y where ink is transferred from the ink ribbon 23 to the paper sheet 1. After that transfer, the ink ribbon 23 is separated from the paper sheet 1 by the separation plate 17Y and is then taken up by the ink ribbon take-up shaft 22.

The platen roller 15Y transfers the paper sheet 1 and the ink ribbon 23 in the same direction at the same speed by being driven and rotated by the motor provided within the housing.

The thermal head 16Y includes a plurality of minute heat generators along a width direction, and the heat generators generate heat when electrical energy is applied from a source thereof. Printing using the yellow ink ribbon loaded in the ink ribbon cassette 20Y is performed by applying energy to the heat generators which produce heat, and that in turn heats the ink of the ink ribbon 23 to transfer the ink to a label along the sheet 23.

The succeeding platen rollers 15M-15B are configured like the platen roller 15Y, the thermal heads 16M-16B are configured like the thermal head 16Y and the separation plates 17M-17B are configured like the separation plate 17Y.

After the paper sheet 1 has passed a position of the platen roller 15Y, it sequentially passes positions of the platen rollers 15M-15B, where printing using the ink ribbons of magenta, cyan, and black respectively loaded in the ink ribbon cassettes 20M-20B is sequentially performed by the respective thermal heads 16M-16B. The paper sheet 1 that has been printed is discharged through a paper sheet outlet.

Further, the printer 10 includes an input unit 30, a control unit 40, a display unit 45, and a detecting sensor 70.

The input unit 30 includes a plurality of operation keys, and is used for operating the printer 10 including inputting data for color printing to the printer 10.

The display unit 45 includes an LCD (liquid crystal display) panel or a plurality of LEDs (light-emitting diodes) for displaying information such as an error message, and displays various indications based on signals supplied from the control unit 40.

Figure 2:
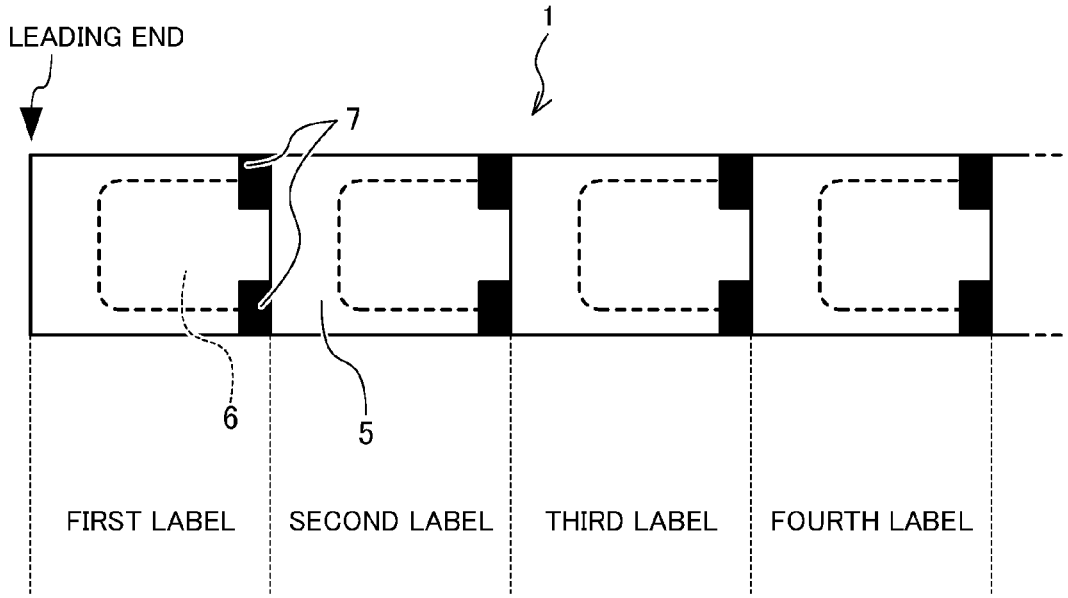
FIG. 2 is a rear-side view of a paper sheet.
Figure 3:
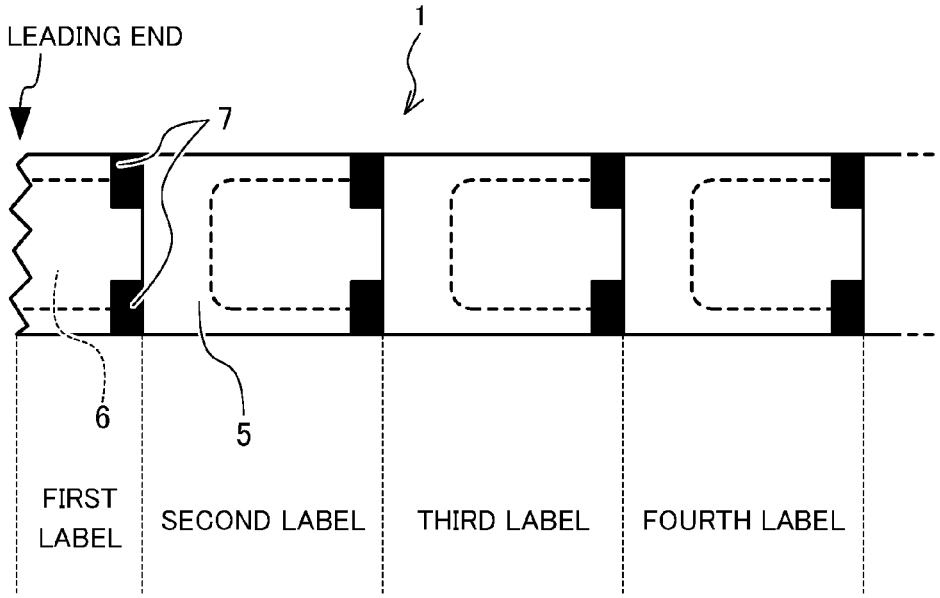
FIG. 3 is a rear-side view of the paper sheet.

The detecting sensor 70 detects a leading end of the paper sheet 1 and eye marks 7 as identification marks (see FIGS. 2 and 3).

FIG. 2 is a rear-side view of the paper sheet 1 that is the side of the sheet opposite the side inked by the ink ribbon 23. FIG. 3 is a rear side view of the paper sheet 1 illustrated in FIG. 2 from which a part of a portion corresponding to a first label is absent. The sheet is comprised of a continuous strip liner 5 on which a succession of individual labels are temporarily adhered. Eye marks 7 are marks provided respectively in association with the labels 6 on a surface of the liner 5 that is opposite a surface of the liner to which the labels 6 are temporarily attached. Each mark is configured as a rectangular black mark, for example.

In FIGS. 2 and 3, there are two side ends at the leading and trailing ends of each label 6 that are substantially perpendicular to a direction along which the liner 5 extends. One side end is closer to the leading end of the paper sheet 1 and is referred to as a front end portion of the label 6, and the other side end is distant from the leading end of the paper sheet 1 and is referred to as a rear end portion of the label 6. In this case, the eye marks 7 are provided near the rear end portion of the label 6 of the liner 5.

The control unit 40 controls operation of each component of the printer 10. For example, upon setting of the paper sheet 1 so as to be rotatably supported around the sheet feed shaft 11, the control unit 40 performs cueing processing illustrated in FIG. 4. This cues the paper sheet 1 by controlling the drive roller 12, the pressure roller 13, and the platen rollers 15Y-15B based on detection by the detecting sensor 70.

Figure 4:
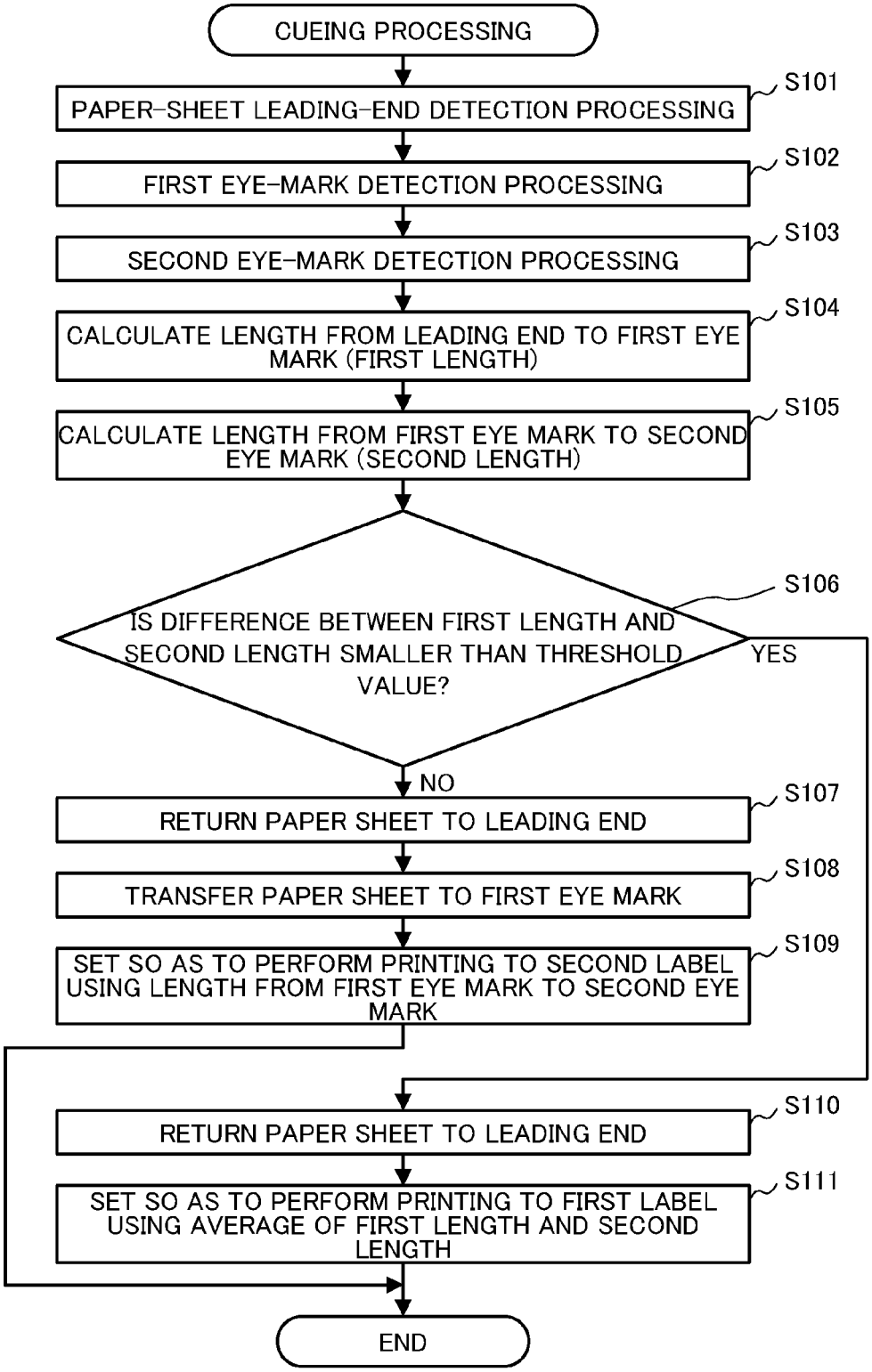
FIG. 4 is a flowchart of a cueing processing of the printer according to the present invention.

FIG. 4 is a flowchart of the cueing processing performed by the control unit 40.

In Step S101, the control unit 40 performs paper-sheet leading-end detection processing. The control unit 40 causes the paper sheet 1 that has entered the housing 14 through the paper sheet supply inlet 18 to be held and transferred between the drive roller 12 and the pressure roller 13, and then the detecting sensor 70 detects the leading end of the paper sheet 1.

In Step S102, the control unit 40 performs first eye-mark detection processing. The control unit 40 causes the paper sheet 1 which is having its leading end detected to be held and further transferred between the drive roller 12 and the pressure roller 13. The detecting sensor 70 detects the eye marks 7 on the back side of the paper sheet 1. It detects the eye marks 7 associated with one of the labels 6 disposed adjacent to the leading end of the paper sheet 1, i.e., the first ones of the eye marks 7 provided in association with a first one of the labels 6.

In Step S103, the control unit 40 performs second eye-mark detection processing, in which the control unit 40 causes the paper sheet 1 having the first ones of the eye marks 7 detected to be held and further transferred between the drive roller 12 and the pressure roller 13, and the detecting sensor 70 to detect the eye marks 7 provided on the back side of the paper sheet 1. This detects the eye marks 7 associated with a second one of the labels 6.

In Step S104, the control unit 40 obtains the length of the paper sheet 1 from its leading end to the first ones of the eye marks 7. The length of the paper sheet 1 from the leading end of the paper sheet 1 to the rear end portion of the first label 6 that is adjacent to the leading end is obtained by obtaining the number of rotations of the drive roller 12 and the pressure roller 13 after the leading end of the paper sheet 1 is detected in Step S101 until the first eye marks 7 are detected in Step S102.

In Step S105, the control unit 40 obtains the length of the paper sheet 1 from the first ones of the eye marks 7 to the second ones of the eye marks 7, i.e., the length of the paper sheet 1 from the rear end portion of the first label 6 to the rear end portion of the second label of the labels 6, by obtaining the numbers of rotation of the drive roller 12 and the pressure roller 13 after the first ones of the eye marks 7 are detected in Step S102 until the second ones of the eye marks 7 are detected in Step S103.

In Step S106, the control unit 40 determines whether or not a difference between the length of the paper sheet 1 from its leading end to the first ones of the eye marks 7 obtained in Step S104 and the length of the paper sheet 1 from the first ones of the eye marks 7 to the second ones of the eye marks 7 obtained in Step S105 is smaller than a predetermined threshold value. If the difference has been determined to be smaller than the threshold value, the process moves to Step S110. If the difference has been determined to be equal to or greater than the threshold value, then the process moves to Step S107.

In Step S107, the control unit 40 causes the paper sheet 1 to be held and transferred between the drive roller 12 and the pressure roller that are in this step rotated backward until the detecting sensor 70 detects the leading end of the paper sheet 1.

In Step S108, the control unit 40 causes the paper sheet 1 to be held and transferred between the drive roller 12 and the pressure roller until the detecting sensor 70 detects the first ones of the eye marks 7. According to this processing, printing is to start from the second one of the labels 6.

In Step S109, the control unit 40 sets such that the printing of the second label 6 is performed using the length of the paper sheet 1 from the first ones of the eye marks 7 to the second ones of the eye marks 7 obtained in Step S105, and the cueing processing shown in FIG. 4 is terminated. According to this processing, for printing on the second label 6, the paper sheet 1 is transferred assuming that the length of the paper sheet 1 from the eye marks 7 provided in association with the first of the labels 6 to the eye marks 7 provided in association with the second of the labels 6 is equal to the length of the paper sheet 1 from the first ones of the eye marks 7 to the second ones of the eye marks 7 obtained in Step S105.

In Step S110, the control unit 40 causes the paper sheet 1 to be held and transferred between the drive roller 12 and the pressure roller that are rotated backward until the detecting sensor 70 detects the leading end of the paper sheet 1. According to this processing, printing is to start from the first label 6.

In Step S111, the control unit 40 sets such that the printing of the first of the labels 6 is performed using an average of the length of the paper sheet 1 from its leading end to the first ones of the eye marks 7 obtained in Step S104 and the length of the paper sheet 1 from the first ones of the eye marks 7 to the second ones of the eye marks 7, and the cueing processing shown in FIG. 4 is terminated. According to this processing, during printing on the first label of the labels 6, the paper sheet 1 is transferred assuming that the length of the paper sheet 1 from its leading end to the first ones of the eye marks 7 is equal to the average of the length of the paper sheet 1 from its leading end to the first eye marks and the length of the paper sheet 1 from the first ones of the eye marks 7 to the second ones of the eye marks 7.

As described above, according to this embodiment, when the difference between the length of the paper sheet 1 from its leading end to the first ones of the eye marks 7 and the length of the paper sheet 1 from the first ones of the eye marks 7 to the second ones of the eye marks 7 is equal to or greater than the threshold value, the printing starts from the second label, without printing on the first label. Accordingly, the printing on the first of the labels 6 is not performed when a part of the first of the labels 6 is absent as shown in FIG. 3, or when the length from the leading end to the first of the labels 6 is longer than usual. Therefore, it is possible to prevent a position for starting printing from going out of alignment, and prevent a printing content from being printed outside the label 6.

Further, when an operator sets the paper sheet 1, the printer 10 performs the cueing processing. Accordingly, it is possible to improve usability for the operator by simplifying the steps of cueing by the operator.

Modified Embodiment

The present invention is not limited to the embodiment described above, and various modifications and alterations are possible without departing from the scope of the present invention.

The embodiment described above has taken the example in which the detecting sensor 70 detects the leading end of the paper sheet 1 and the eye marks 7. Alternatively, the detecting sensor 70 may detect a region of the liner 5 to which the labels 6 are not attached, i.e., a label gap, instead of detecting eye marks 7.

Further, the paper sheet 1 is not limited to a label continuous body, but may alternatively be any sheet member as long as the detection of the length of each unit of the sheet is possible.

It should be appreciated that the present invention is not limited to the embodiments described above.

REFERENCE SIGNS LIST

1: Paper Sheet
5: Liner
6: Label
7: Eye Mark
10: Printer
15A, 15B, 15C, 15D: Platen Roller
16A, 16B, 16C, 16D: Thermal Head
20A, 20B, 20C, 20D: Ink Ribbon Cassette
23A, 23B, 23C, 23D: Ink Ribbon
40: Control Unit
70: Detecting Sensor

The invention claimed is:

1. A printer for performing printing on a series of units on a surface of a sheet, wherein the units are arranged along a length direction of the sheet, the printer comprising:

a transfer device configured to transfer the sheet in the length direction;

a leading end detector configured to detect a leading end of the sheet during transfer by the transfer device;

an end portion detector configured to detect an end portion of each of individual units arranged along the sheet; and a control device configured to obtain a length of one of the units that is adjacent to the leading end of the sheet during the transfer of the sheet based on the detection by the leading end detector and the end portion detector, and to controlling the transfer device according to a result that has been obtained;

wherein the control device is configured to perform:

a first step of obtaining a length of the sheet in the length direction after the leading end is detected by the leading end detector and until a rear end portion of a first unit on the sheet adjacent to the leading end is detected by the end portion detector;

a second step of obtaining a length of the sheet in the length direction after the rear end portion of the first unit on the sheet is detected by the end portion detector until a rear end portion of a second of the units of the sheet is detected by the end portion detector; and a third step wherein when a difference between the length obtained in the first step and the length obtained in the second step is smaller than a predetermined threshold value, starting printing on the first of the units adjacent to the leading end of the sheet, and when the difference between the length obtained in the first step and the length obtained in the second step is equal to or greater than the threshold value, starting printing on the second of the units adjacent to the first of the units of the sheet.

2. The printer according to claim 1, wherein the sheet has respective identification marks associated with each unit of the sheet; and the end portion detector is configured to detect the end portion of each unit of the sheet by detecting the identification marks.

3. The printer according to claim 1, wherein when the difference between the length obtained in the first step and the length obtained in the second step is smaller than the threshold value in the third step, the control device starts printing on the first unit of the sheet assuming that a length of the sheet from the leading end of the sheet to the rear end portion of the first unit on the sheet is equal to an average of the length obtained in the first step and the length obtained in the second step.

4. The printer according to claim 3, wherein each of the units is a printable label supported on the sheet.

5. The printer according to claim 3, wherein the sheet has respective identification marks associated with each unit of the sheet; and the end portion detector is configured to detect the end portion of each unit of the sheet by detecting the identification marks.

6. The printer according to claim 1, wherein each of the units is a printable label supported on the sheet.

7. A method of printing on a sheet having a plurality of units arranged along the length of the sheet, the method comprising:

transferring the sheet along a length direction, with a leading end of the sheet leading the sheet as the sheet is transferred and the units on the sheet are transferred with the sheet;

detecting the leading end of the sheet as the sheet is transferred;

detecting an end portion of each of the units as the sheet is transferred;

determining the length of one of the units that is adjacent to the leading end of the sheet based on the detecting of the leading end of the sheet and the detecting of the end portion of each of the units;

a first step of obtaining a length of the sheet after the leading end is detected by the leading end detector and until a rear end portion of a first unit on the sheet adjacent to the leading end is detected by the end portion detector; and a second step of obtaining a length of the sheet after the rear end portion of a first of the units on the sheet is detected by the end portion detector until a rear end portion of a second of the units of the sheet is detected by the end portion detector; and a third step wherein when a difference between the length obtained in the first step and the length obtained in the second step is smaller than a predetermined threshold value, starting printing on the first of the units adjacent to the leading end of the sheet member, and when the difference between the length obtained in the first step and the length obtained in the second step is equal to or greater than the threshold value, starting printing on the second of the units adjacent to the first of the units on the sheet.

8. A method according to claim 7, further comprising wherein when the difference between the length obtained in the first step and the length obtained in the second step is smaller than the threshold value in the third step, the control device starts the printing on the first unit of the sheet when a length of the sheet from the leading end of the sheet to the rear end portion of the first unit of the sheet is equal to an average of the length obtained in the first step and the length obtained in the second step.

9. A method according to claim 7, wherein each of the units is a printable label on the sheet.

* * * * *